US006145192A

United States Patent [19]

Moyaert et al.

[11] Patent Number: 6,145,192

[45] Date of Patent: Nov. 14, 2000

[54] DEVICE AND METHOD FOR FITTING INDIVIDUAL WIRES TO IDC CONTACTS

[75] Inventors: Werner Moyaert, Snellegem; Philippe Van Steenkiste, Deerlijk, both of Belgium

[73] Assignee: Siemens Aktiengesellschaft, Munich, Germany

[21] Appl. No.: 09/243,830

[22] Filed: Feb. 1, 1999

Related U.S. Application Data

[63] Continuation of application No. PCT/DE97/01560, Jul. 23, 1992.

[30] Foreign Application Priority Data

Aug. 1, 1996 [DE] Germany ..... 196 31 152

[51] Int. Cl.[7] ..... H01R 43/04; H01R 43/00

[52] U.S. Cl. ..... 29/866; 29/749; 29/33 F

[58] Field of Search ..... 29/749, 866, 33 F

[56] References Cited

U.S. PATENT DOCUMENTS

| | | | |
|---|---|---|---|
| 3,972,101 | 8/1976 | Casey et al. | 29/749 |
| 4,047,294 | 9/1977 | Quigley | 29/749 |
| 4,085,497 | 4/1978 | Nijman et al. . | |
| 4,175,320 | 11/1979 | Nijman | 29/749 |
| 4,182,029 | 1/1980 | Nijman | 29/749 |
| 4,210,997 | 7/1980 | Holt | 29/749 X |
| 4,307,505 | 12/1981 | Jozens | 29/749 X |
| 4,349,944 | 9/1982 | Fickes | 29/749 X |
| 4,384,402 | 5/1983 | Petree | 29/749 |
| 5,125,150 | 6/1992 | Meyer | 29/749 X |
| 5,152,051 | 10/1992 | Folk et al. . | |
| 5,212,882 | 5/1993 | Hamonko et al. . | |
| 5,737,823 | 4/1998 | Walker | 29/749 X |

FOREIGN PATENT DOCUMENTS

| | | |
|---|---|---|
| 3717121A1 | 12/1987 | Germany . |
| 660935A5 | 5/1987 | Switzerland . |

OTHER PUBLICATIONS

"Steckverbinder Datenbuch" (plug connector data book), ISSN 0936–1774, Siemens Aktiengesellschaft, vol. 1/90, pp. 5.68–5.69.

*Primary Examiner*—Carl J. Arbes
*Attorney, Agent, or Firm*—Herbert L. Lerner; Laurence A. Greenberg; Werner H. Stemer

[57] ABSTRACT

The device has a base frame having a lever arm that is pivotably mounted at one end and, at its other end, carries a pressure punch. The press punch is moved on a circular path toward individual wires as a result of a manual actuation of the lever arm, and presses the individual wires into IDC contacts as a result of pressure being exerted linearly by a handle provided on a pivoting element.

8 Claims, 4 Drawing Sheets

DEVICE AND METHOD FOR FITTING INDIVIDUAL WIRES TO IDC CONTACTS

CROSS-REFERENCE TO RELATED APPLICATION

This is a continuation of copending International Application PCT/DE97/01560, filed Jul. 23, 1997, which designated the United States.

BACKGROUND OF THE INVENTION

1. Field of the Invention

In various applications, for example in backplane systems, insulation displacement connection (IDC) cable connectors are used, for example in order to be able to connect a number of systems to one another. In the case of these IDC cable connectors, a number of cables having a number of individual wires have to be fitted to the IDC contacts. A processing tool is needed for fitting the individual wires, specifically a crimping tool for field use, a workshop crimping tool, a semiautomatic tool or a fully automatic tool are necessary, depending on the numbers and the environment in which they are used.

U.S. Pat. No. 5,212,882 discloses a device for fitting individual wires to IDC contacts which have a baseplate on which there is disposed a stand which serves as a bearing block for a total of five pivotable lever arms. A pivotable lever arm for holding the IDC contacts is provided on one side of the bearing block. Two further pivotable lever arms for the holders for the individual wires are provided on two other, mutually opposite sides of the bearing block. In addition, two further pivotable lever arms each having a handle, a connecting link and a pressure element at the pivotable end are in turn disposed on these sides of the bearing block. The known device thus has a very complicated configuration and is unwieldy.

SUMMARY OF THE INVENTION

It is accordingly an object of the invention to provide a device and a method for fitting individual wires to IDC contacts which overcome the above-mentioned disadvantages of the prior art devices and methods of this general type, which is suitable for both operation in the field and for workshop use, permits the simultaneous fitting of a number of individual wires to IDC contacts, and can be manually actuated.

With the foregoing and other objects in view there is provided, in accordance with the invention, a device for fitting wires into contacts, including: a base frame; a first holder disposed on the base frame for receiving insulation displacement connection (IDC) contacts; a second holder disposed on the base frame separate from the first holder and for receiving individual wires; a pressure punch for pushing the individual wires into the IDC contacts; a handle movably mounted on the base frame; and a single lever arm having a first end supporting the punch press and a second end pivotably mounted on the base frame for moving the pressure punch toward the IDC contacts in a circular path, an actuation of the handle causing the single lever arm to move the pressure punch toward the individual wires for pushing the individual wires into the IDC contacts received and fixed on the base frame.

In order to achieve the object, the invention provides a device for fitting the individual wires to the IDC contacts which has a base frame on which separate holders for the IDC contacts and the individual wires are fixed. The single lever arm is pivotably mounted at one end on the base frame, and at the other end, carries a pressure punch for pushing the individual wires into the IDC contacts, so that the pressure punch can moved toward the IDC contacts on a circular path when the lever arm is pivoted. The pressure punch is moved toward the individual wires as a result of the actuation of a handle that acts on the pivoted-in lever arm, so that the individual wires are pushed into the IDC contacts fixed on the base frame.

Devices which can be found on the market, in which the fitting of the individual wires to the IDC contacts is carried out by a linear movement of a pressure punch in the direction of the IDC contacts, are certainly suitable. In the known workshop version for fitting a number of individual wires to the IDC contacts, the devices have to be placed on a table and are often also unwieldy, whereas in the field version they are suitable only for fitting one IDC contact per operation.

In the case of the device of the invention, the pressure punch is guided on a circular movement path by being disposed at one end of a lever arm which, at its other end, is pivotably mounted on a base frame. The fitting is therefore essentially brought about as a result of a circular movement of the pressure punch in conjunction with a handle that acts on the pivoted-in lever arm. Therefore, the device of the invention can be constructed as a compact, lightweight tool and can be used universally as a crimping tool both for field use and for workshop use. In addition, the device can be actuated manually, and it is possible for a number of individual wires to be fitted simultaneously to IDC contacts.

With the foregoing and other objects in view there is also provided, in accordance with the invention, a method for fitting wires into contacts, which includes: inserting insulation displacement connection (IDC) contacts into a holder disposed in a base frame; introducing a cutting element between the holder for the IDC contacts and a lever arm; laying individual wires in a further holder disposed on the base frame and feeding the individual wires over the IDC contacts to the cutting element; manually pivoting in the lever arm and a pivoting element having a handle until a pressure punch rests on the individual wires; exerting pressure linearly via the handle on the lever arm and the pressure punch; and cutting the individual wires to a given length with the cutting element and pushing individual cut wires into the IDC contacts with the pressure punch.

Other features which are considered as characteristic for the invention are set forth in the appended claims.

Although the invention is illustrated and described herein as embodied in a device and a method for fitting individual wires to IDC contacts, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
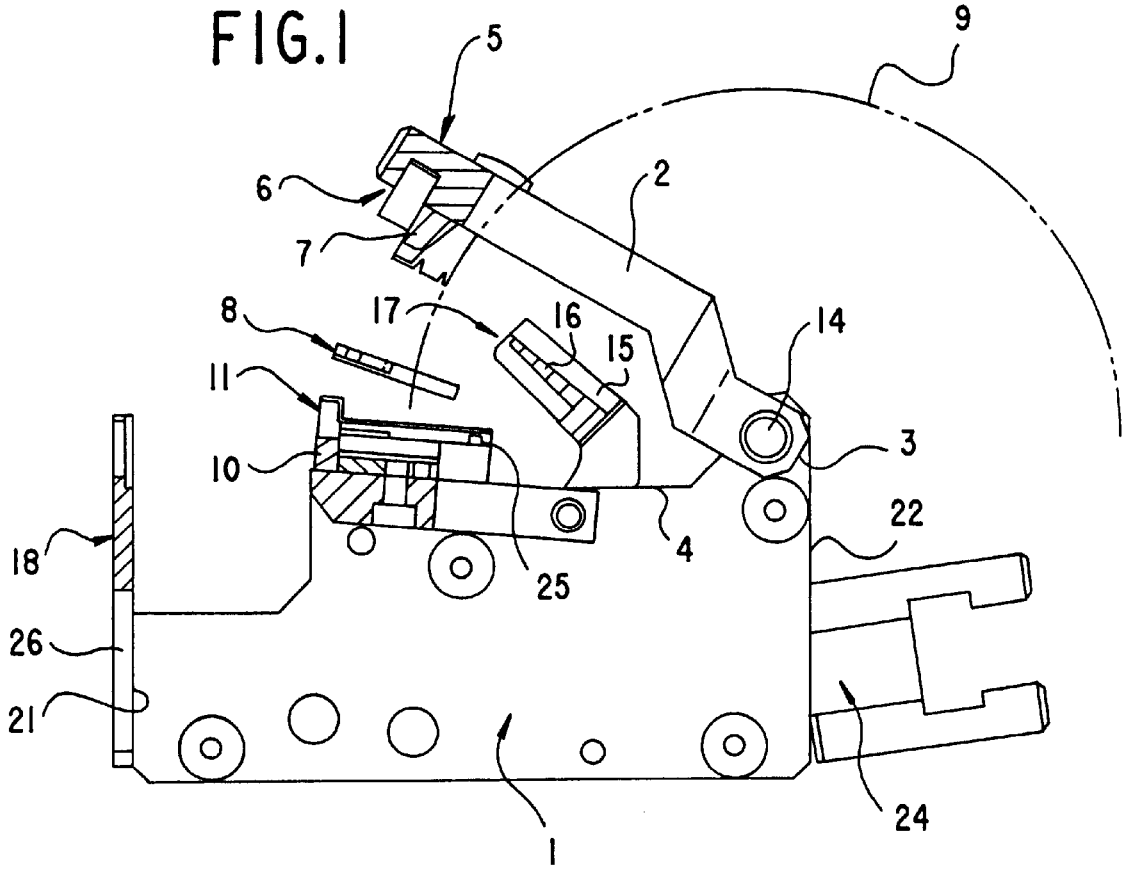
FIG. 1 is a left, side-elevational view of a basic construction of a device according to the invention.

In all the figures of the drawing, sub-features and integral parts that correspond to one another bear the same reference symbol in each case. Referring now to the figures of the drawing in detail and first, particularly, to FIG. 1 thereof, there is shown a device having a base frame 1 on which all the further components are disposed, including a lever arm 2 that is pivotably hinged at one end 3 to a top 4 of the base frame 1. At another end 6 of the lever arm 2, which is configured to have an adjustable height stop 5, there is a pressure punch 7. The pressure punch 7 is provided for pushing a number of individual wires 19 into IDC contacts 8 and, by being fitted to the pivotable lever arm 2, is disposed such that the pressure punch 7 can be moved toward the IDC contacts 8 on a circular path 9, which is drawn with dash-dotted wires, when the lever arm 2 is pivoted. Furthermore, a holder 10 for the IDC contacts 8 is provided on the top 4 of the base frame 1. The holder 10 may for example be configured as a bearing block having an upwardly projecting stop 11 which interacts with the height stop 5 of the lever arm 2 and thus limits the pivoting movement of the latter and at the same time serves as a rest for the IDC contacts 8. The holder 10 is disposed in the region of the pivoting path 9 of the pressure punch 7. In order to avoid any damage to IDC walls 12 (FIG. 2) which project upward in a wire connection region and in each case enclose an insulation displacement slot between themselves, when the pressure punch 7 pushes the individual wires into the IDC contacts 8, the pressure punch 7 is provided with appropriate cutouts 13 on its bottom, facing the IDC contacts 8.

Figure 6:
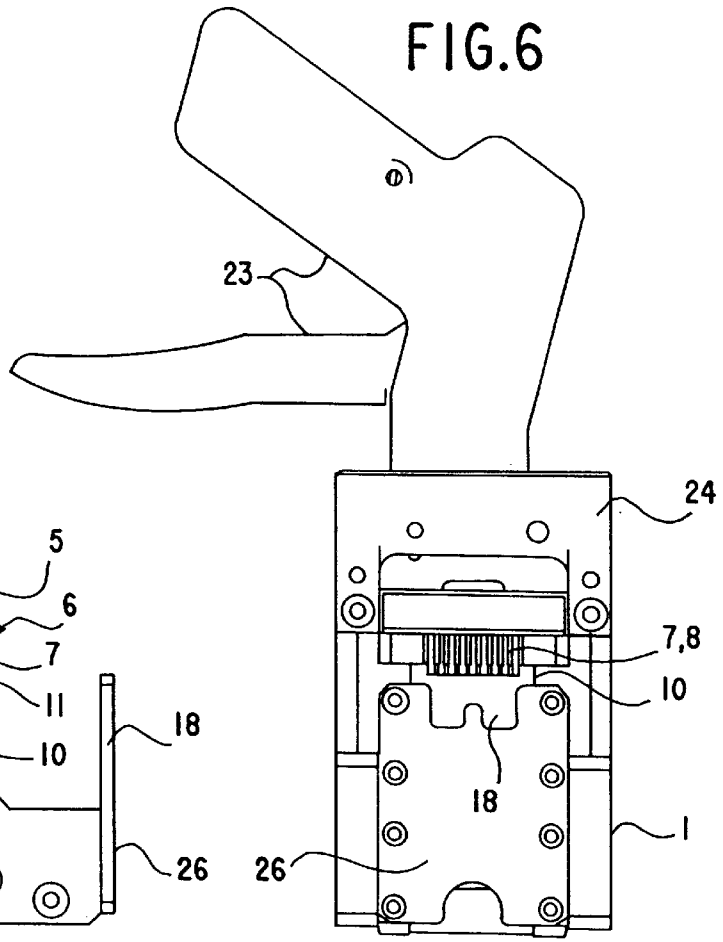
FIG. 6 is a front elevational view of the device.

In addition, a cutting element 15 is disposed on the top 4 of the base frame 1 between the holder 10 for the IDC contacts 8 and a bearing 14 of the lever arm 2. The cutting element 15 has a cutting plate 16 which is disposed on a flap 17 which is pivotably mounted at one end on the base frame 1 and as is further described later cuts the individual wires 19 to length. Finally, a further holder 18 for the individual wires 19 to be fitted or for a cable 20 containing the individual wires is provided on the base frame 1. The further holder 18 is configured as a plate-shaped part 26 disposed on an outer side face 21 of the base frame 1 (see also FIG. 6). The individual wires 19 are then passed from the further holder 18, over the stop 11 of the holder 10, onto the cutting plate 16 of the cutting element 15.

Figure 5:
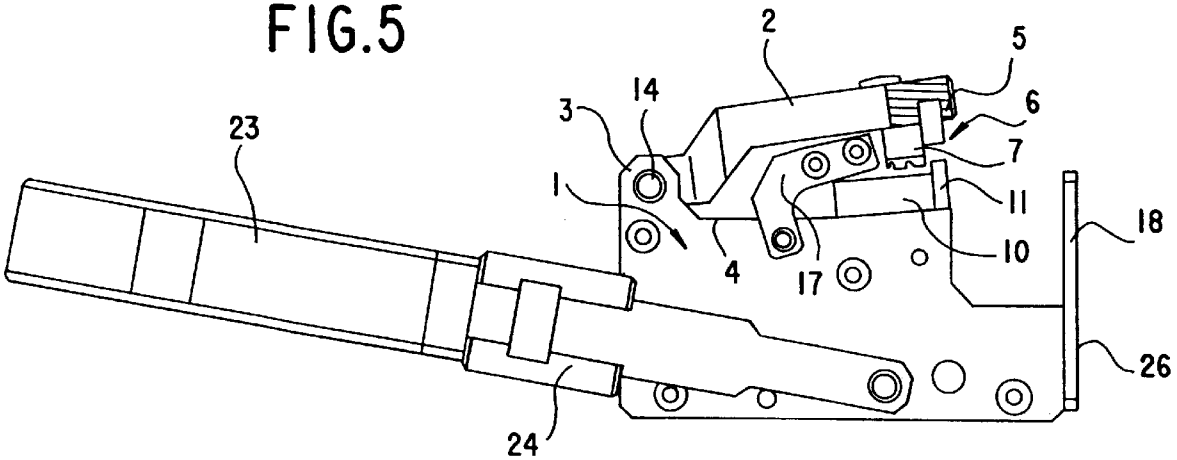
FIG. 5 is a right, side-elevational view of the device having a handle.
Figure 7:
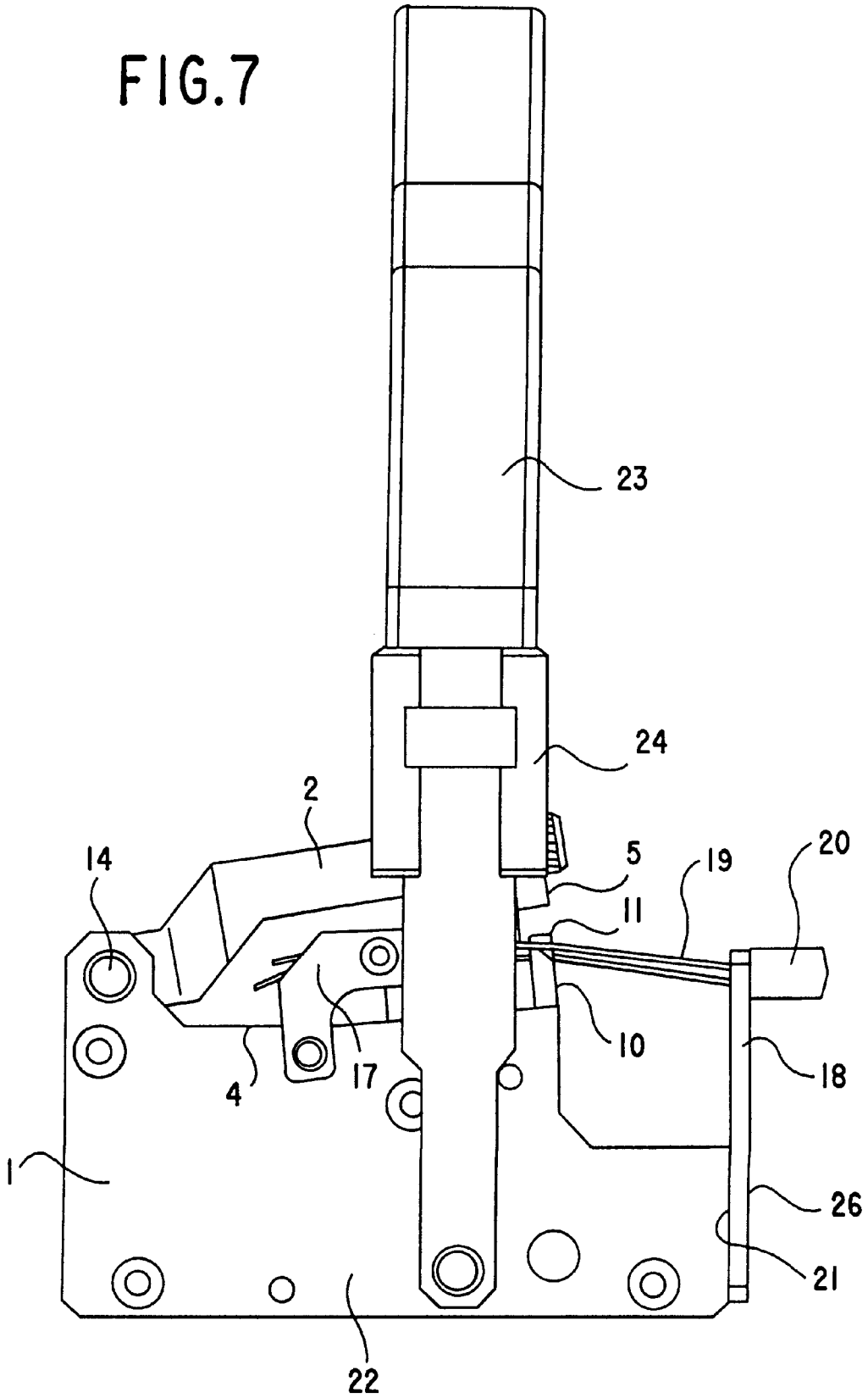
FIG. 7 is a right, side-elevational view of the device having the handle in a raised position in comparison to FIG. 5.

In order to actuate the fitting operation manually, the device is further configured to have a handle 23 (FIGS. 5 and 7), which is inserted into a pivoting element 24, on a further outer side face 22 of the base frame 1.

Figure 2:
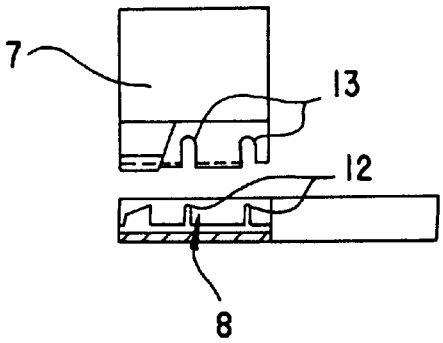
FIG. 2 is a side-elevational view of a pressure punch and of an IDC contact for the device according to FIG. 1.
Figure 3:
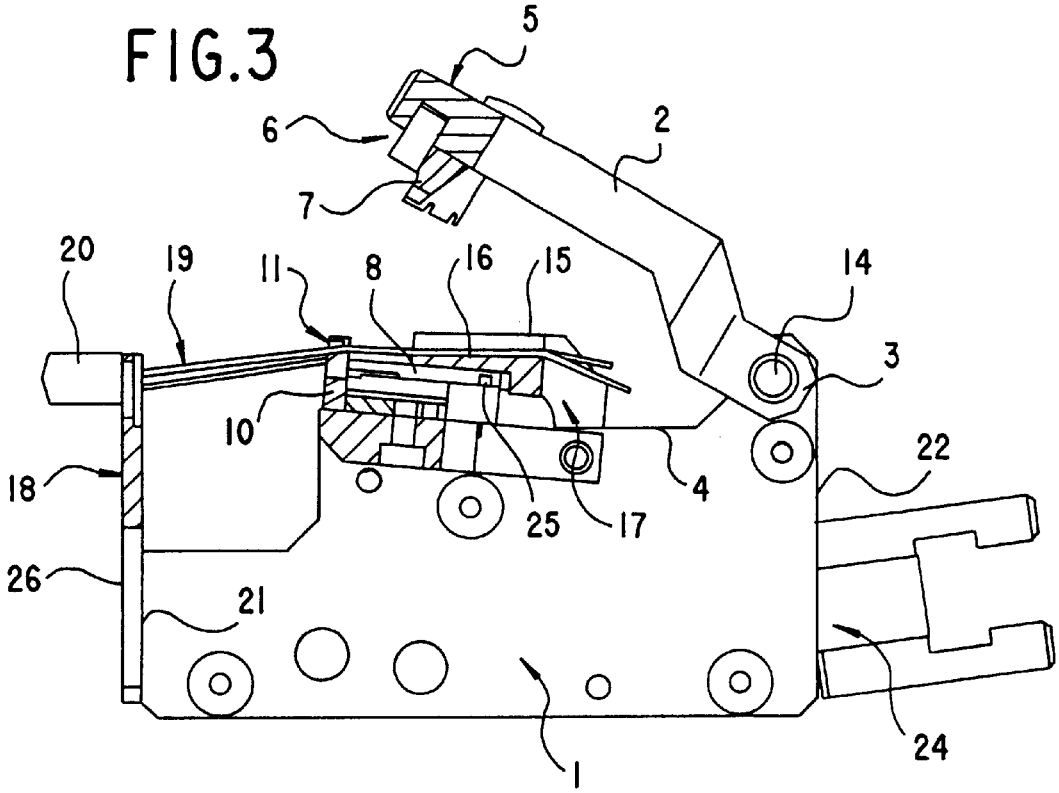
FIG. 3 is a left, side-elevational view of the device according to FIG. 1 with individual wires inserted therein.
Figure 4:
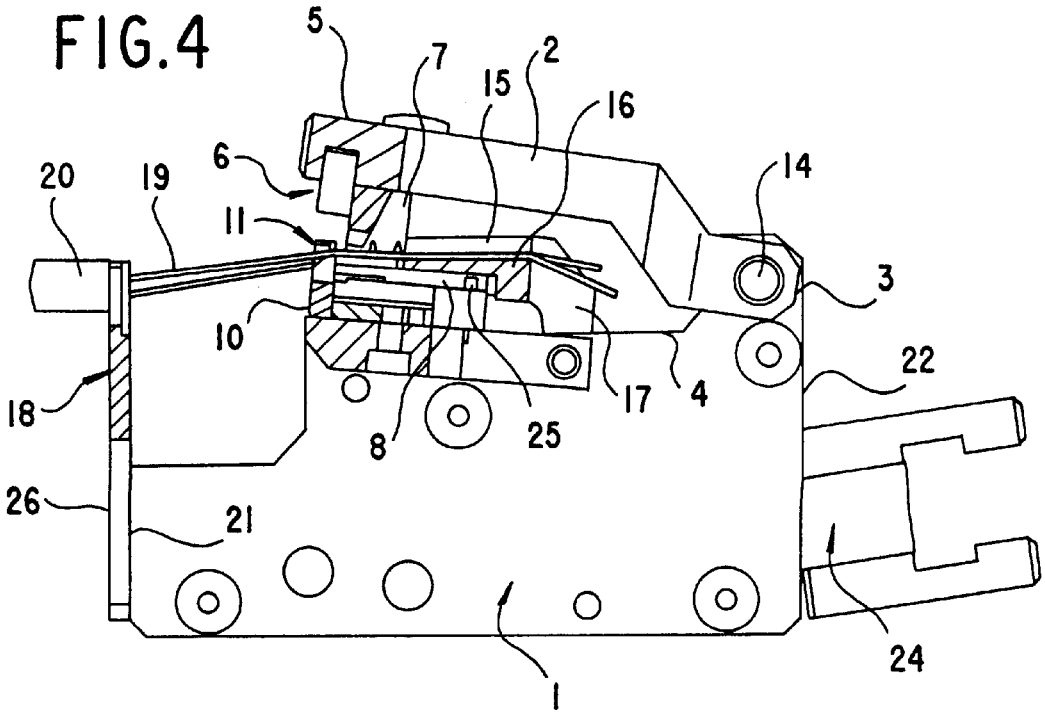
FIG. 4 is a left, side-elevational view of the device in a state before the individual wires have been cut and pushed into IDC contacts.

The fitting operation itself will be explained in more detail below with reference to FIGS. 2 to 4.

First of all, the device is equipped with IDC contacts 8 by the latter being laid in the holder 10 and secured in position there, for example by the stop 11 of the holder 10 and a pin 25. The cutting element 15 with its cutting plate 16 is then pivoted in between the holder 10 and the lever arm 2. The individual wires 19 are then laid in the further holder 18 and are fed over the already inserted IDC contacts 8 onto the cutting plate 16 and, if necessary, firmly clamped here. The lever arm 2 is then pivoted in manually until the pressure punch 7 rests on the individual wires 19. After the pivoting element 24 has been pivoted in manually, a pressure is exerted linearly on the lever arm 2 and the pressure punch 7 by the handle 23, by which the individual wires 19 are cut to length on the cutting plate 16 and pushed into the IDC contacts 8. To this end, the configuration and arrangement of the lever arm 2 and of the flap 17 are matched to each other in such a way that the individual wires are satisfactorily cut off and then fitted to the IDC contacts 8.

We claim:

1. A device for fitting wires into contacts, comprising:

a base frame;

a first holder disposed on said base frame for receiving insulation displacement connection (IDC) contacts;

a second holder disposed on said base frame separate from said first holder and for receiving individual wires;

a pressure punch for pushing the individual wires into the IDC contacts;

a handle movably mounted on said base frame;

a single lever arm having a first end supporting said punch press and a second end pivotably mounted on said base frame for moving said pressure punch toward the IDC contacts in a circular path, an actuation of said handle causing said single lever arm to move said pressure punch toward the individual wires for pushing the individual wires into the IDC contacts received and fixed on said base frame; and a cutting element disposed on said base frame and movable between said single lever arm and said first holder for cutting the individual wires to a given length.

2. The device according to claim 1, wherein said cutting element has a flap with an end pivotably mounted on said base frame and a cutting plate disposed on said flap.

3. The device according to claim 1, wherein said single lever arm (2) has an adjustable height stop in a region of said pressure punch.

4. The device according to claim 3, wherein said first holder for receiving the IDC contacts has a stop, and said height stop of said single lever arm interacts with said stop of said first holder.

5. The device according to claim 1, wherein said base frame has an outer side face, and said second holder for receiving the individual wires has a plate-shaped part disposed on said outer side face of said base frame.

6. The device according to claim 1, wherein said base frame has a top, and said first holder for receiving the IDC contacts has a bearing block disposed on said top of said base frame and facing said single lever arm in an area of the circular path of said pressure punch.

7. The device according to claim 1, wherein the IDC contacts have IDC walls projecting upwards and enclosing an insulation displacement contact slot between adjacent IDC walls, and said pressure punch has a side formed with cutouts therein and facing said IDC walls of the IDC contacts.

8. The device according to claim 1, including a pivoting element disposed between said handle and an outer side of said base frame opposite said second holder for receiving the individual wires.

* * * * *